United States Patent [19]

Houghton-Brown et al.

[11] 4,453,485

[45] Jun. 12, 1984

[54] DEVICE FOR REMOTELY STEERING A BOAT

[76] Inventors: Patrick D. Houghton-Brown, 1133 Pipeline Rd., Coquitlam, British Columbia; Blayney J. Scott, 21 Erie St., Victoria, British Columbia, both of Canada

[21] Appl. No.: 300,305

[22] Filed: Sep. 8, 1981

[51] Int. Cl.[3] ..... B63H 25/52

[52] U.S. Cl. ..... 114/144 A; 74/494

[58] Field of Search ..... 114/144 R, 144 A, 146; 74/494, 480 B; 180/132; 167/74

[56] References Cited

U.S. PATENT DOCUMENTS

| | | | |
|---|---|---|---|
| 2,928,291 | 3/1960 | Wilkerson | 114/144 R |
| 3,549,143 | 12/1970 | Gilliam | 267/74 |
| 3,648,539 | 3/1972 | Rouis | 74/494 |

*Primary Examiner*—Sherman Basinger

*Attorney, Agent, or Firm*—Carver & Co.

[57] ABSTRACT

A device for remotely steering a boat includes a friction drive wheel for frictionally driving the steering wheel of the boat. There is a reversible motor connected to the friction wheel for rotating the friction wheel. Shock cords resiliently bias the friction wheel towards the steering wheel. A remotely locatable motor control selectively rotates the motor in a desired direction of rotation and thereby steers the boat as the friction wheel rotates the steering wheel.

6 Claims, 5 Drawing Figures

DEVICE FOR REMOTELY STEERING A BOAT

BACKGROUND OF THE INVENTION

This invention relates to a device for remotely steering a boat which includes a friction drive wheel frictionally driving the steering wheel and resilient means for biasing the friction wheel towards the steering wheel.

Relatively small boats, usually powered by an outboard motor or an inboard-outboard motor, are frequently used by sport fishermen for trolling. Such boats are commonly steered by a front-mounted steering wheel, providing steering control similar to that of an automobile. However, when trolling, the fisherman must be near the stern of the boat which means that the steering wheel is out of reach.

The result may be both dangerous and inconvenient for a fisherman attempting to troll by himself. Even though the vessel is operating at a relatively slow speed, it is impossible to alter course while the fisherman is at the stern of the vessel. Safe operation therefore requires another person to steer the vessel and means that a fisherman should not troll alone.

Remote steering devices have been developed in the past as shown, for example, in U.S. Pat. No. 3,895,545 to Hunter. This device is intended for steering the front wheel of a vehicle during alignment and repair. It is relatively complex and, accordingly, would be expensive to manufacture and sell. Moreover, it occupies the entire seat at the driving position, would be difficult to put in position and remove and requires considerable storage space.

SUMMARY OF THE INVENTION

The invention provides a device for remotely steering a boat having a steering wheel. The device comprises a friction drive wheel for frictionally driving the steering wheel. A reversible motor means is connected to the friction wheel for rotating the friction wheel. There is resilient means for resiliently biasing the friction wheel towards the steering wheel. A remotely locatable motor control selectively rotates the motor means in a desired direction of rotation and thereby steers the boat as the friction wheel rotates the steering wheel.

Preferably, the friction wheel has a peripheral surface of an elastomeric surface for frictionally engaging the steering wheel.

The device may further comprise a housing hingedly connectable to the boat by a hinge means. The friction wheel is rotatably mounted on the housing. The motor means may comprise a direct current electric motor within the housing.

The resilient means may, for example, comprise a stretchable cord.

The invention offers significant advantages over earlier remote steering devices such as that disclosed in U.S. Pat. No. 3,895,545 to Hunter. For example, because the friction drive wheel is biased against the steering wheel by the resilient means, the operator's seat is unoccupied by the device. When the fisherman wishes to regain direct steering control through the steering wheel, it is simply necessary to detach the resilient means, which may be stretchable cord, so the friction drive wheel no longer engages the steering wheel. The device is very simple, requiring only a single moving part—the friction drive wheel mounted on a motor shaft. The complex mechanism including gears as found in the Hunter patent is not required. The invention therefore provides a device which may be manufactured and marketed at a price affordable by many sport fishermen. It makes feasible safe trolling by a fisherman alone in a small boat.

DESCRIPTION OF THE PREFERRED EMBODIMENT

Figure 1:
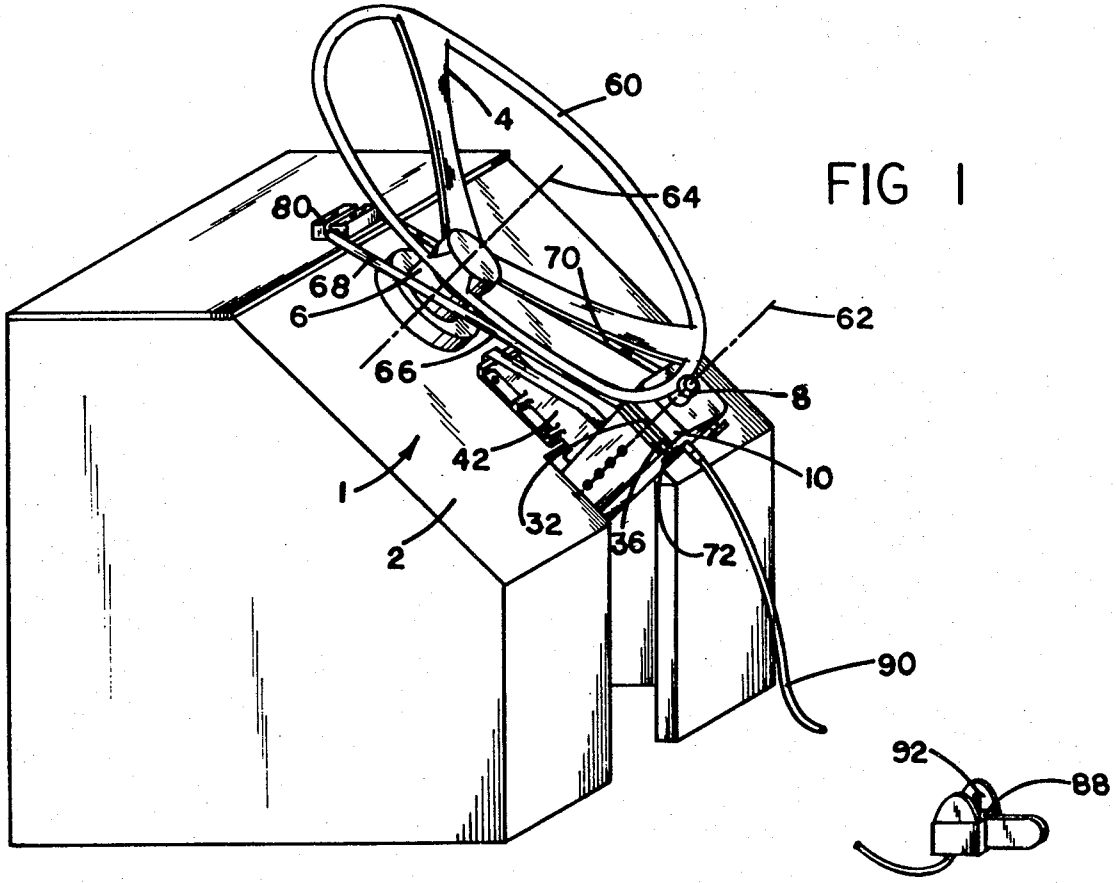
FIG. 1 is a perspective view of a device for remotely steering a boat, shown installed on the dash of a small boat.

FIG. 1 illustrates a device 1 for remotely steering a boat, only the dashboard 2 being illustrated together with steering wheel 4 and steering shaft 6 connected thereto.

Figure 2:
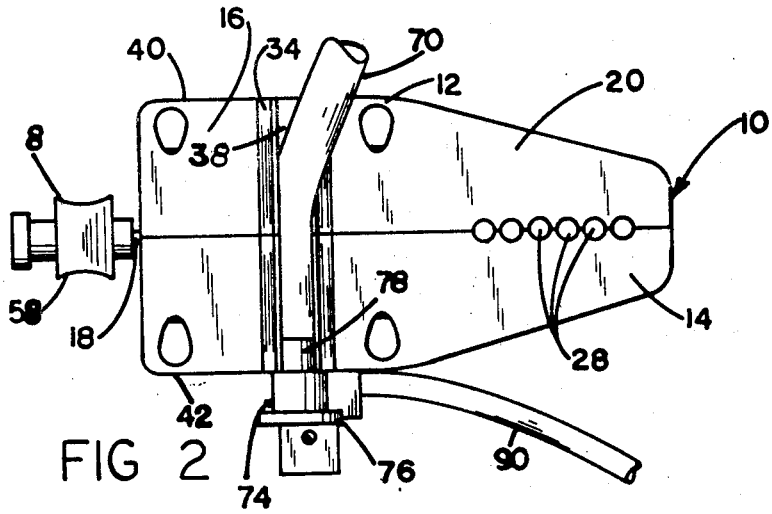
FIG. 2 is an elevation view showing one side of the motor housing for the device of FIG. 1.
Figure 3:
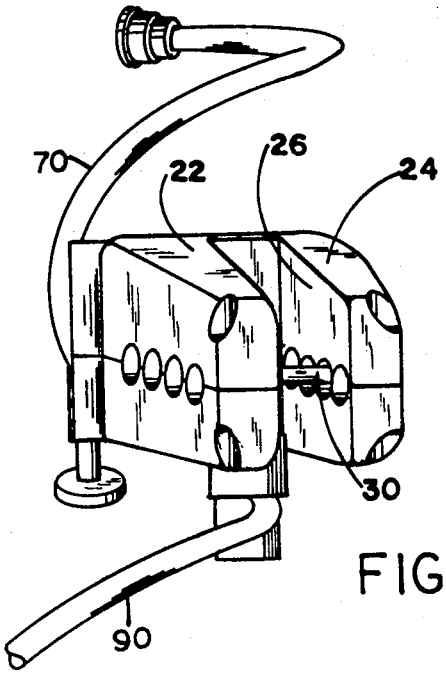
FIG. 3 is a perspective view showing the bifurcated rearward portion of the motor housing.

The device 1 includes a friction drive wheel 8 rotatably mounted on a housing 10 as best seen in FIGS. 2 and 3. Housing 10 in the preferred embodiment is constructed of hollow plastic and has identical top and bottom halves 12 and 14 which are held together by screws. The housing has a forward portion 16 which houses a direct current electric motor, only the output shaft 18 of which is shown. A heavy duty automotive fan motor provides suitable power for the device and operates on voltage available from the battery in most boats. The housing also has a bifurcated rearward portion 20 comprising a first half 22 and a second half 24 as shown in FIG. 3. An opening 26 separates each half 22 and 24.

As seen best in FIG. 2, a plurality of openings 28 extend through the rearward portion 20. A pin 30, shown in FIG. 3, extends across opening 26 between halves 22 and 24 of the rearward portion 20. Pin 30 is tightly fitted within one of the apertures 28, but may be removed and pressed into another aperture 28 if desired.

As shown in FIG. 1 and FIG. 2, there is an elongated protrusion 32 and 34 on each side of housing 10, having semi-cylindrical recesses 36 and 38 respectively. The protrusions and recesses extend from the top 40 to the bottom 42 of the housing. Each recess is generally semi-cylindrical in shape, but the width of the opening of each recess is slightly narrower than its internal diameter.

Figure 4:
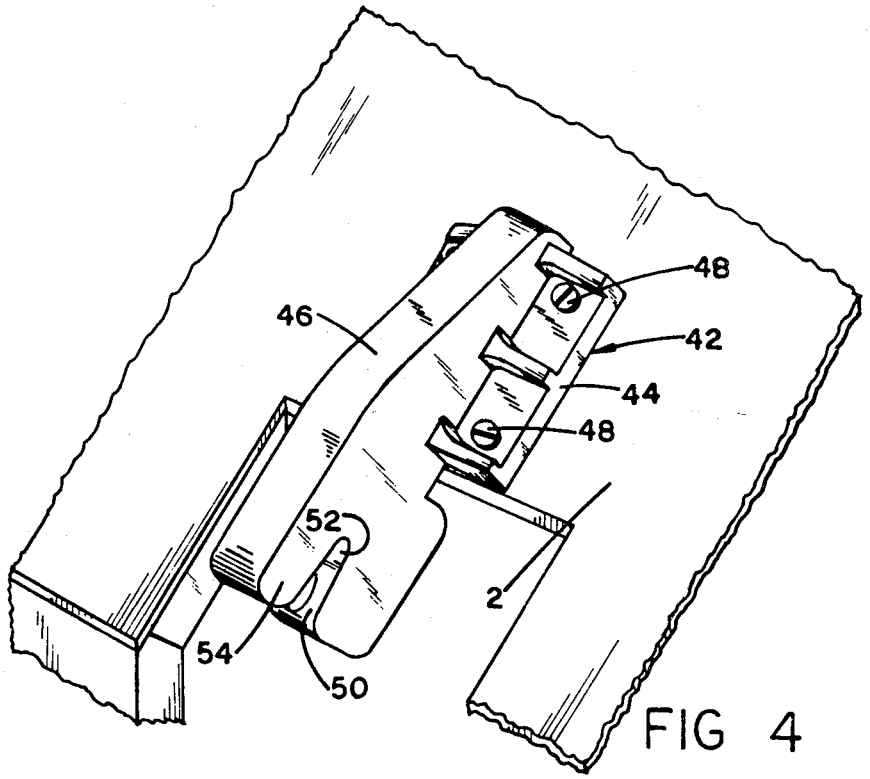
FIG. 4 is a perspective view of a mounting member for the motor housing.

Pin 30 and opening 26 of the housing, together with mounting member 42 shown in detail in FIG. 4, comprise hinge means for hingedly connecting the housing 10 to the dashboard 2 of the boat. Mounting member 42 comprises an integral mounting plate 44 and hook-like projection 46. Mounting plate 42 is connected to the boat below the steering shaft 6 as seen in FIG. 1. The mounting plate 42 is connectable to the dashboard 2 by a plurality of screws 48 as seen in FIG. 4.

The hook-like projection 46 has a slot 50 and is mounted on the dashboard 2 so the slot opens downwardly from an inner end 52 thereof as seen in FIG. 4.

FIG. 1 shows how projection 46 is receivable within opening 26 of the housing. Finger 54 of projection 46 extends above pin 30 and the pin is normally against the inner end 52 of slot 50. Projection 46 is slightly narrower than opening 26 of the housing so that, with the pin received within slot 50, the housing is free to pivot about pin 30.

Friction wheel 8 is tightly fitted to the output shaft 18 of the motor and is thereby rotatably mounted on the housing 10. The friction wheel has an outer circumferential groove 58 which is shaped to receive the rim 60 of the steering wheel 4 as seen in FIG. 1. Friction wheel 8 is used to frictionally drive the steering wheel 4. In order to provide sufficient grip, the friction wheel 8 of the preferred embodiment is made of an elastomeric substance, such as rubber or a synthetic rubber substitute. Certain plastics having similar frictional and resilient properties would also be suitable. In order to provide the grip, it is sufficient that the peripheral surface of the friction wheel within groove 58 has a coating of such an elastomeric substance. When the device is in the operational position, as shown in FIG. 1, axis of rotation 62 of friction wheel 8 is generally parallel to the axis of rotation 64 of the steering wheel 4.

The device has resilient means for resiliently biasing the friction wheel 8 against the steering wheel. This resilient means includes a single length of stretchable cord 66 looped to form two separate lengths 68 and 70, as seen in FIG. 1. Such stretchable cords are well known and comprise a core of an elastic material with a stretchable textile covering. They are commonly known as "shock cords". While the use of a stretchable cord is preferred in this embodiment, for reasons such as simplicity, economy and safety, it should be appreciated that other resilient tension members could be substituted such as a length of stretchable rubber or a long coil spring. Cylindrical fittings 72 and 74 are fitted to first ends of each length of cord adjacent housing 10 as seen in FIG. 1 and FIG. 2. These fittings are identical and, referring to FIG. 2, each has a circular flange 76, providing a convenient finger grip, and a cylindrical projection 78 adjacent the cord and coaxial therewith, which has a diameter less than the rest of the projection and slightly less than the internal diameter of each of the semi-cylindrical recesses 36 and 38 in the housing. Fittings 72 and 74 together with recesses 36 and 38 provide means for connecting the first or bottom ends of the lengths 68 and 70 of the shock cord to housing 10 as seen in FIG. 1. The lengths of shock cord are first fitted into the recesses 36 and 38 with the fittings 72 and 74 below protrusions 32 and 34. When tension is then applied to the shock cord, cylindrical projections 78 are pulled upwardly into recesses 36 and 38 until the remaining portions of fittings 72 and 74 contact the bottom ends of protrusions 32 and 34, respectively. The lengths of cord are thus connected to housing 10. They may be released simply by grasping flanges 76 of the fittings and pulling downwardly until projections 78 clear protrusions 32 and 34 and then pulling the shock cords outwardly from recesses 36 and 38.

Figure 5:
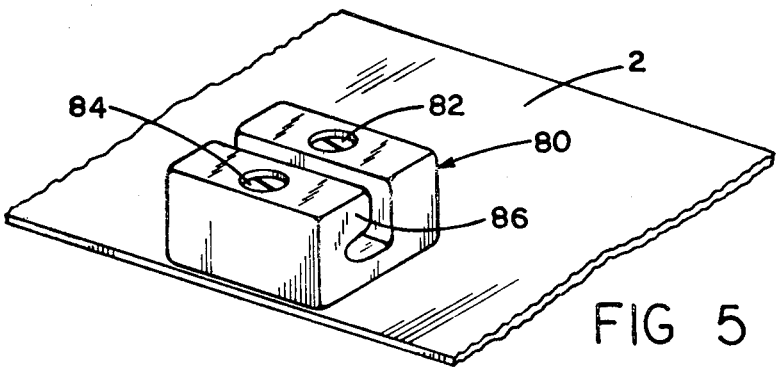
FIG. 5 is a perspective view of a fitting for holding one end of a resilient means of the device shown in FIG. 1.

Referring to FIG. 1 and FIG. 5, there is a hook fitting 80 connected to the dashboard 2 above steering shaft 6 by a pair of screws 82 and 84. A broad hook 86 is formed in fitting 80 and, as seen in FIG. 1, the stretchable cord 66 is looped about this hook in use. Fitting 80 is positioned so that the distance between hook 86 and the bottom end of protrusions 32 and 34 on housing 10 is less than the unstretched lengths 68 and 70 of the cord. Accordingly, when the ends of the cord are connected to housing 10 by cylindrical fittings 72 and 74, the cord must be stretched in order to loop it over hook 86 on fitting 80. The stretchable cord thereby provides resilient means for resiliently biasing friction wheel 8 against the steering wheel 4. With the two lengths of cord 68 and 70 under tension on opposite sides of the steering shaft 6, an upwards force is exerted on housing 10 so that pin 30 is held against the inner end of the slot 50 on mounting member 42. At the same time, housing 10 is pivotted or hinged about pin 30 until friction drive wheel 8 presses against the steering wheel.

It may be appreciated from FIG. 1 that the distance between the dashboard 2 and rim 60 of the steering wheel 4 may vary for different boats. Consequently, an adjustment is necessary to make sure that circumferential groove 58 coincides with the rim of the steering wheel when pin 30 is received within slot 50. This adjustment is made by moving pin 30 to the appropriate aperture 28 in housing 10, each of which is generally perpendicular to the axis of rotation 62 of the friction wheel. This permits adjustment of the position of the friction wheel along the axis of rotation for proper engagement with the steering wheel.

With reference to FIG. 1, the device has a remotely locatable motor control 88 which is electrically connected to the motor in housing 10 by an electrical cable 90. Control 88 has a three-position switch 92. In the central position, no power is supplied to the motor, so the course of the boat is maintained. When pushed upwardly, power is supplied to the motor to rotate friction drive wheel 8 and thereby steering wheel 4 in one direction. When the switch is pulled downwardly past the central position, the polarity of the current supplied to the motor is reversed and the steering wheel is accordingly steered in the opposite direction. Cable 90 should be long enough to reach to the back of the boat and the operator can steer the boat in either direction simply by using switch 92. As disclosed above, power for the motor can be supplied by the starting battery in the boat and brought to the motor by standard electrical cables.

The device may be installed easily on almost all boats because only two permanent fixtures, namely fitting 80 and mounting member 42, are connected to the dash by screws or the like. The first step is to properly center mounting member 42 below the steering column with slot 50 facing downwardly and then locating it so that the axis of rotation 62 of friction wheel 8 is parallel to the axis of rotation 64 of the steering wheel when pin 30 is against inner end 52 of slot 50.

If necessary, pin 30 is moved to another aperture 28, shown in FIG. 2, so that groove 58 on the friction wheel properly presses against the rim of the steering wheel.

Stretchable cord 66 is then looped about the steering shaft and cylindrical fittings 72 and 74 are connected to the housing 10 while the cord is maintained under tension. Hook fitting 80 is then located so that there is sufficient tension on the cord to press friction wheel 8 against the steering wheel tightly when the cord is received over hook 86. The device is then ready for use once power has been supplied to the motor from the boat's battery.

Once the fisherman wishes to resume normal steering, he simply moves to the seat behind the steering wheel while holding motor control 88. Once he is able to hold the wheel, the circular flange 76 on one of the cylindrical fittings 72 or 74 is grasped and pulled downwardly to disengage the fitting from its recess 36 or 38 on housing 10. With the cord disconnected from the housing on one side, the tension on the cord is released and the cord is removed from hook 86. Pin 30 is then pulled downwardly out of slot 50 and housing 10 can be moved to a convenient storage location.

The invention therefore clearly provides a simple and convenient device for remotely steering a boat.

What is claimed is:

1. A device for remotely steering a boat having a steering wheel and a mounting surface adjacent the steering wheel, the device comprising:

a motor housing;

reversible motor means in the housing;

a friction drive wheel connected to the motor for frictionally driving the steering wheel;

a remotely locatable motor control for selectively rotating the motor means in the desired direction of rotation and thereby steering the boat;

hinge means connectable to the mounting surface for hingedly mounting the motor housing, the hinge means comprising a mounting member for mounting on the boat, the mounting member having a slot, and a pin on the housing receivable in the slot; and resilient means connectable to the motor housing for biasing the motor housing towards the steering wheel so the friction wheel engages the steering wheel.

2. A device as claimed in claim 1, wherein the housing has a plurality of apertures for receiving the pin which are generally perpendicular to the axis of rotation of the friction wheel, permitting adjustment of the position of the friction wheel generally along the axis of rotation thereof for engagement with the steering wheel.

3. A device as claimed in claim 2, wherein the boat has a steering shaft connected to the steering wheel and the mounting member is connectable to the boat below the steering shaft, so the slot opens downwardly from an inner end thereof, the pin on the housing being held against the inner end by the resilient means.

4. A device as claimed in claim 3, wherein the housing has a bifurcated rearward portion with an opening separating each half thereof, the apertures extending through the rearward portion, the pin extending across the opening, and the mounting member having a mounting plate for mounting on the boat and a hook-like projection, the slot being on the hook-like projection, the hook-like projection being receivable about the pin within the opening of the housing.

5. A device for remotely steering a boat having a steering wheel and a mounting surface adjacent the steering wheel, the device comprising:

a motor housing;

reversible motor means in the housing;

a friction drive wheel connected to the motor means for frictionally driving the steering wheel; a remotely locatable motor control for selectively rotating the motor means in the desired direction of rotation and thereby steering the boat; hinge means connectable to the mounting surface for hingedly mounting the motor housing; and resilient means connectable to the motor housing for biasing the motor housing towards the steering wheel so the friction wheel engages the steering wheel, the resilient means comprising two lengths of stretchable cord, each said length having a first end connectable or connected to the housing and a second end connectable to the boat at a position such that the lengths of cord are stretched and thereby bias the housing so the friction wheel presses against the steering wheel.

6. A device as claimed in claim 5, further comprising a fitting mountable on the boat above the steering shaft for holding the lengths of cord and wherein the lengths of cord comprise a single piece of shock cord which is looped about the fitting in use.

* * * * *